United States Patent [19]

Snow et al.

[11] 4,140,466

[45] Feb. 20, 1979

[54] APPARATUS FOR FORMING WALLS

[76] Inventors: Harold A. Snow, 3429 S. Carson, Sp. 30, Carson City, Nev. 89701; Robert A. Garrett, 509 Mt. Whitney, Klamath Falls, Oreg. 97601

[21] Appl. No.: 801,645

[22] Filed: May 31, 1977

[51] Int. Cl.[2] ..... E04G 11/34

[52] U.S. Cl. ..... 425/110; 249/18; 249/93; 425/63; 425/289

[58] Field of Search ..... 264/34; 425/63–65, 425/289, 470, 110; 249/20, 93, 18

[56] References Cited

U.S. PATENT DOCUMENTS

| | | | |
|---|---|---|---|
| 2,470,671 | 5/1949 | Withrow | 425/63 |
| 2,899,735 | 8/1959 | Graef | 249/93 |
| 3,358,343 | 12/1967 | Kahili | 425/289 |

*Primary Examiner*—Richard B. Lazarus
*Assistant Examiner*—John McQuade
*Attorney, Agent, or Firm*—Eugene M. Eckelman

[57] ABSTRACT

To accomplish the invention, a backing panel is slidably supported on longitudinal rails in turn supported on upright portable frame members. The frame members removably support a header plate and such header plate in turn is arranged to support a wire mesh in suspended relation. Air blown concrete is deposited on the wire mesh against the backing panel to form the wall, the backing panel being movable on its supporting rails progressively as wall sections are formed. The upright portable frame members support a vertical cutter in the form of a continuous power driven wire movable along the front of the newly formed wall to provide a flat, smooth face thereon.

4 Claims, 5 Drawing Figures

20
18
19
14
40
38
4
96
102
100
18
36
44
54
98
99
50
94
42
52
56
32
34
30
22
104
58
52
72
44
58
46
48
50
58
68
70
72
81
80
88
90
4
56
30
86
10
34
32
1
1
52
70
74
22
94
18
19
14
18
54
44
96
20
50

APPARATUS FOR FORMING WALLS

BACKGROUND OF THE INVENTION

This invention relates to new and novel apparatus for forming walls.

Walls have heretofore been formed in sections either in a factory or poured flat at the site and then the sections combined to form the integral wall structure. Although such means of forming a wall may comprise an improvement over the use of upright forms into which concrete is poured, there nevertheless is the disadvantage that such preformed wall sections must be transported from their point of manufacture or if poured at the site there is a time delay while the concrete is setting up before the wall sections can be raised. Furthermore, in this latter instance, heavy machinery is required to raise the walls. Structures have also been formed by air blown material but the formation of upright walls has not thus far been feasible in view of the problems arising in forming such sections.

SUMMARY OF THE INVENTION

According to the present invention and forming primary objectives thereof, apparatus is provided which utilizes a vertical support against which a wall can be formed by air placed concrete and which is movable laterally progressively as the wall is formed, thus providing for a rapid and continuous formation of a wall structure.

More particular objects of the invention are to provide wall forming apparatus employing a plurality of upright portable vertical frame members which support the backing panel for lateral adjustable movement and which have support means thereon for removably holding a header plate from which a wire mesh is suspended in front of the backing panel for incorporation into the wall structure; to provide on the portable frame members a laterally movable facing cutter to face off the front wall in a straight and smooth surface; and to provide power drive means for the backing panel as well as the facing cutter for suitable operation as the wall is being formed.

The invention will be better understood and additional objects and advantages will become apparent from the following description taken in connection with the accompanying drawings which illustrate a preferred form of the device.

DETAILED DESCRIPTION OF A PREFERRED EMBODIMENT

Figures 1, 4, 5:
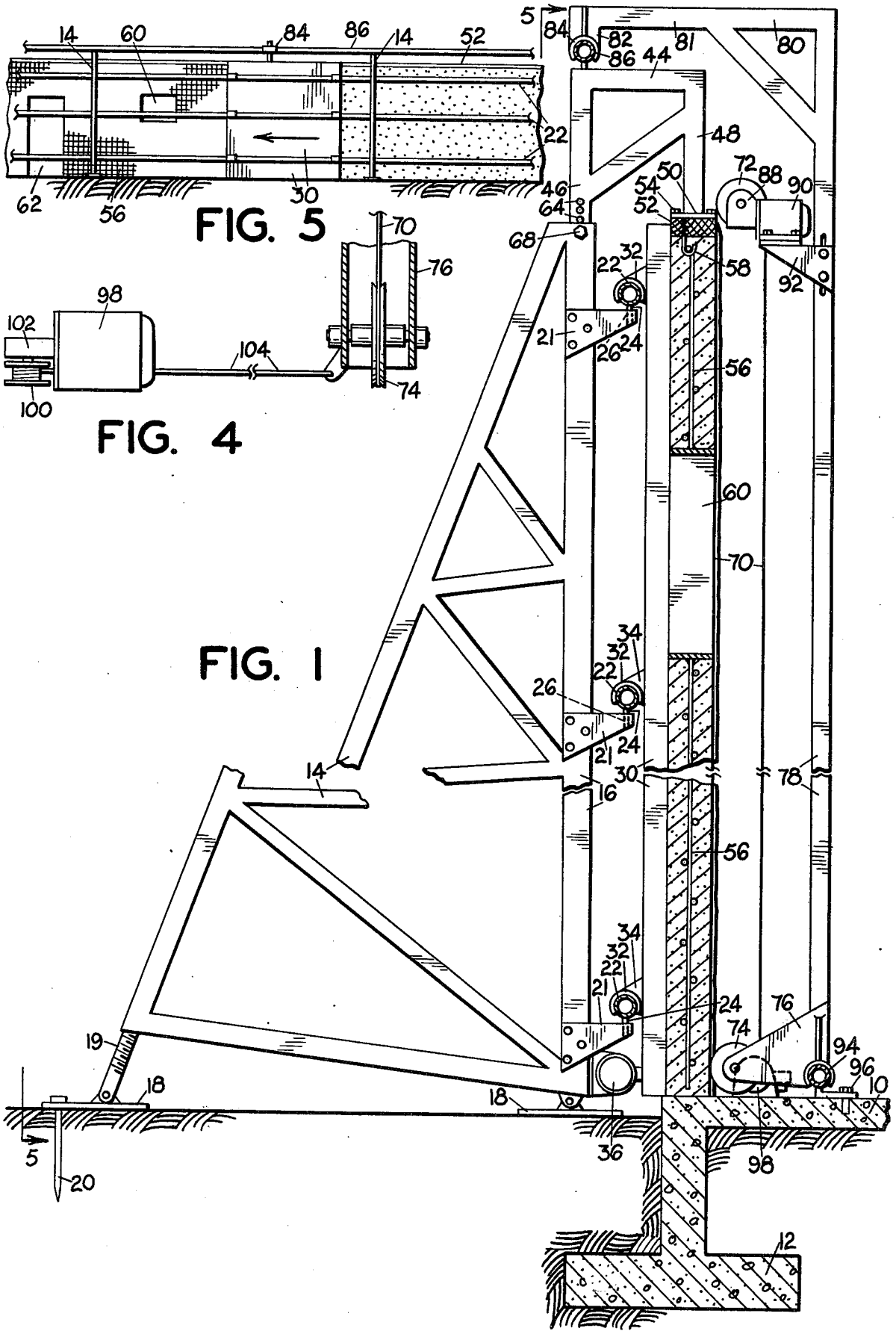
FIG. 1 is a vertical foreshortened sectional view taken through apparatus of the invention and showing a wall structure being formed thereby, said view being taken on the line 1—1 of FIG. 2.
FIG. 4 is an enlarged foreshortened fragmentary sectional view taken on the line 4—4 of FIG. 2.
FIG. 5 is a view in reduced scale taken on the line 5—5 of FIG. 1 and showing a wall structure being constructed by the formation of adjacent sections according to the invention.

The present invention was intended for use with a process of panel construction which utilizes an air gun arranged to eject a special form of concrete by force against a supporting panel. Such apparatus is well known in the art and utilizes a particular composition of concrete having characteristics allowing it to be blown into place. The composition is of selected consistency and has fast set-up characteristics. A material which has the characteristics desired is known in the trade under the trade-mark Gunite.

For the purpose of illustration, the present apparatus is shown in connection with the formation of an upstanding wall for a building or the like, although it is to be understood that the present apparatus could be used for the formation of any type of wall such as retainer wall. For the present illustration, the mechanism is shown in combination with a poured floor 10 of concrete or the like having a footing 12.

The apparatus comprises at least two upright frames or trusses 14 preferably triangular in shape with one portion 16 of the frame being vertical. The frame 14 is supported on foot members 18 one of which, preferably the outer one, provides vertical positioning of the portion 16 if necessary by means of an extension 19 pivotally connected to the foot member and having threaded engagement in the bottom of the frame member. Anchor means 20 such as spikes passing through the foot members and into the ground may be utilized to hold the outer ends of the frames 14 down.

Each frame 14 has upper and lower and one or more intermediate brackets 21 extending forwardly in integral relation from vertical portion 16, and supported on these brackets between two or more of the frames 14 are lateral rails 22. These rails are preferably supported on short posts 24 having removable socket support 26 in the brackets.

A backing panel 30 is slidably supported on the rail 22 by inverted sockets 32 supported on rearwardly extending brackets 34 integral with the rear side of panel 30. One end frame 14 integrally supports an electric motor 36, FIGS. 1 and 2, at the lower front end thereof, and this motor drives a drum 38 connected thereto by means of a reduction gear box 40. A line 42 is connected to the drum and has its free end connected to one end of the panel 30. Upon operation of the motor, the panel is moved laterally toward the drum.

Supported on the upper end of each frame 14 is an inverted U-shaped extension 44 having one leg portion 46 mounted in the top of the frame 14 and the other leg portion 48 depending forwardly of the frame. The lower end of the leg 48 has an enlargement 50 with a flat bottom face. A header member 52 is adapted to be removably secured to the enlargements 50 of two or more frames 14, and this header member will comprise a part of the wall when formed. Removable connection of the header member to the extensions 44 is accomplished by lag screws 54 or the like which as will be seen are removable after the wall has been formed.

The header member 52 provides a support for a reinforcing wire core 56 such as wire mesh. This core extends the full height of the wall, having support on hooks 58 screwed into the underside of header member 52. The reinforcing core 56 may have suitable window structures 60, FIGS. 3 and 5, doors 62, FIG. 5, or other necessary openings set therein in a well known manner.

With the structure thus far described, namely, a backing panel 30 and a wire core, concrete of the type mentioned is air blown into place to form the wall. Preferably, the extension 44 has vertical adjustment, and for this purpose the leg 46 thereof extends into a socket in the top of the frame 14 and includes a plurality of adjusting holes 64 therein engageable selectively by a removable pin 68.

The face of the wall is finished off into a smooth vertical surface by a vertical continuous strand 70, such as wire, operating over upper and lower pulleys 72 and 74, respectively. Lower pulley 74 is rotatably supported on a bracket 76 secured to an upright leg 78 of a carrier 80.

The carrier has a rearward top extension 81 with a downturned end 82 terminating in a bottom opening socket 84 slidably engaged with a rail 86 supported on extensions 44 of two or more frame members 14.

The upper pulley 72 is secured on the output shaft of a reduction gear box 88 of an electric motor 90 supported on a bracket 92 in turn supported on the leg 78 of the carrier 80. The bracket 92 is located at a position on the carrier 80 such that pulley 72 will be at least as high as a header plate 52 on a wall.

Figures 2, 3:
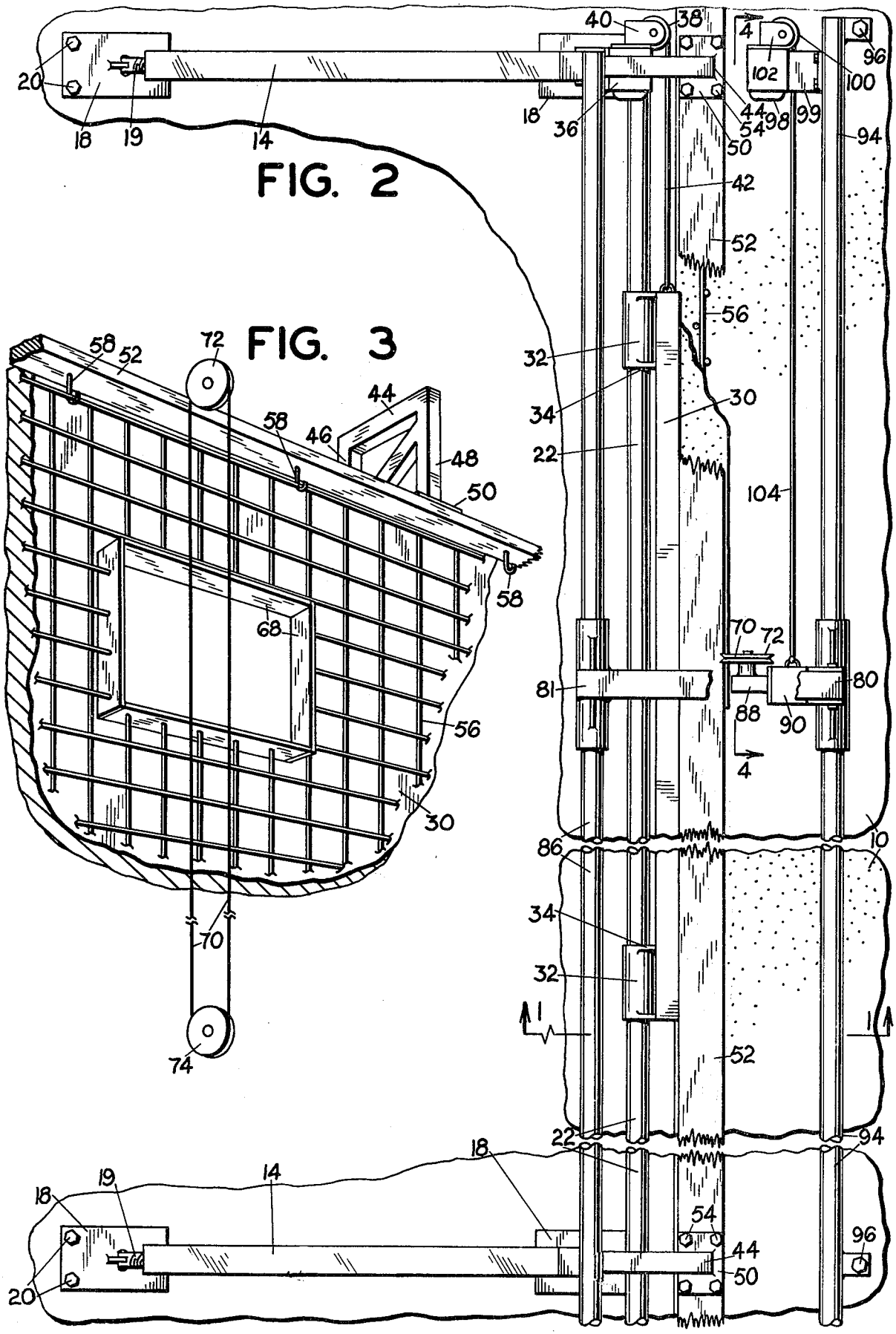
FIG. 2 is a foreshortened top plan view of the apparatus.
FIG. 3 is a fragmentary perspective view of a wall and a portion of the apparatus forming said wall, a portion of the apparatus, comprising the facing cutter, being shown diagrammatically.

The bottom end of the leg 78 has a downwardly opening socket slidably engaged with a rail 94 which is temporarily attached to the floor as by screws 96 in a selected place through the length of the wall to support the leg 78 as well as to selectively position the cutting wire 70 relative to the wall. An electric motor 98, FIGS. 2 and 4, is secured to one end of rail 94 as by means of a bracket 99 and drives a drum 100 through a gear reduction box 102. A line 104 is secured on the drum and has its free end connected to bracket 76 whereby the motor is operative to pull the carrier 80 in the process of facing the wall.

In the formation of a wall and as best apparent in FIG. 5, it is preferred that the spacing between the frame members 14 be at least as great as or greater than twice the width of backing panel 30, or better yet the total length of the wall to be formed. Thus, after the formation of a wall section which comprises the width of the backing panel 30 and after the selected drying period, the panel is moved to the end of the formed wall section so that another section can be formed. After wall sections have been formed which are the width of the frames 14 as positioned, the latter are moved as desired to provide the construction of additional wall sections if necessary. For moving such frames, the extensions are first detached from the header members 52. Also, when the frames 14 are to be relocated, the support rail 94 for the bottom of leg 78 is also re-located. The apparatus and process hereof therefore provides for a wall construction which does not require any forms and which can be formed progressively from one end of the wall to the other. Such provides for a rapid and inexpensive wall construction.

It is to be understood that the form of my invention herein shown and described is to be taken as a preferred example of the same and that various changes in the shape, size and arrangement of parts may be resorted to without departing from the spirit of my invention or the scope of the subjoined claims.

Having thus described my invention, I claim:

1. Apparatus for forming a wall comprising (a) upright frame means, (b) an upright backing panel having a forward face, (c) support means on said upright frame means supporting said panel in upright position on said frame means, (d) said support means supporting said backing panel for lateral adjustable movement for repositioning it for formation of another wall section adjacent to and in line with a first wall section, (e) an extension on the upper portion of said frame means arranged to suspend wall elements adjacent to the forward face of said backing panel whereby a wall is formed by depositing air blown material on said forward face in association with the suspended wall elements and then moving the said panel away from the formed wall when the latter is self-supporting, (f) a carrier mounted on said frame means for slidable movement along the formed wall, (g) and powered cutting means movable with said carrier and arranged to cut excess blown material from the face of the wall formed against said backing panel.

2. The apparatus of claim 1 including power means connected to said carrier for moving said carrier laterally.

3. The apparatus of claim 2 wherein said powered cutting means comprises a vertically disposed continous cutting strand operable over upper and lower pulleys, and electric motor drive means for rotating one of said pulleys to drive said strand.

4. Apparatus for forming a wall comprising (a) at least two upright end frame means spaced from each other in a lateral direction in which a wall is to be formed, (b) an upright backing panel having a forward face, (c) support means extending between said upright frame means supporting said backing panel for lateral movement, (d) a forwardly extending frame portion on the upper end of each of said frame means, (e) means on said forwardly extending frame portions arranged for removable attachment to a lateral header member and arranged to support such a header member and suspended wall elements adjacent to the forward face of said backing panel whereby a wall is arranged to be formed by depositing air blown material on said forward face of said backing panel in association with the suspended wall elements and then moving the said backing panel away from the formed wall when the latter is self-supporting, (f) said support means being of greater width than said backing panel and supporting said backing panel for lateral adjustable movement for re-positioning it for formation of another wall section adjacent to and in line with a first wall section that has been formed on said backing panel.

* * * * *